United States Patent [19]

Ollinger et al.

[11] Patent Number: 4,489,529

[45] Date of Patent: Dec. 25, 1984

[54] REINFORCED CEILING RUNNER

[75] Inventors: James C. Ollinger; Melvin H. Shaub, both of Lancaster, Pa.

[73] Assignee: Armstrong World Industries, Inc., Lancaster, Pa.

[21] Appl. No.: 458,339

[22] Filed: Jan. 17, 1983

[51] Int. Cl.[3] ..... E04C 3/30

[52] U.S. Cl. ..... 52/732; 52/484

[58] Field of Search ..... 52/732, 729, 484

[56] References Cited

U.S. PATENT DOCUMENTS

| | | | |
|---|---|---|---|
| 1,253,216 | 1/1918 | Day | 52/732 |
| 3,004,640 | 10/1961 | Macomber | 52/732 |
| 3,083,794 | 4/1963 | Stovall, Jr. | 52/732 X |
| 3,189,138 | 6/1965 | Znamirowski | 52/729 |
| 3,189,139 | 6/1965 | Znamirowski | 52/729 |
| 3,509,669 | 5/1970 | Plemeng | 52/729 |
| 3,570,198 | 3/1971 | Ruhnke | 52/729 |

FOREIGN PATENT DOCUMENTS

| | | | |
|---|---|---|---|
| 0965215 | 4/1975 | Canada | 52/732 |

*Primary Examiner*—Carl D. Friedman

[57] ABSTRACT

A ceiling runner is provided with added strength to its T-bar configuration. The runner is fabricated with a double piece vertical web and two horizontal flanges. The T-bar is strengthened by fastening together the double web structure at the region of the base of the vertical web. The fastening together of the double web structure can be carried out through the use of a hot melt adhesive, a welding, a lancing pattern, etc.

1 Claim, 2 Drawing Figures

REINFORCED CEILING RUNNER

BACKGROUND OF THE INVENTION

1. Field of the Invention

The invention is directed to a specific ceiling runner and, more particularly, to a reinforced ceiling runner.

2. Description of the Prior Art

U.S. Pat. No. 4,206,578 is directed to a typical double web capped T-bar grid.

U.S. Pat. No. 3,845,544 is directed to a method of forming sheet metal structures wherein the sheet metal components are glued together.

U.S. Pat. No. 3,725,169 is directed to a sheet metal structure where two metallic sheets are bonded together.

U.S. Pat. No. 3,029,914 is directed to a sheet metal structure where two sheet metal structures have been adhesively joined together and the sheet metal structures have also been fabricated to a specific shape.

SUMMARY OF THE INVENTION

The invention is directed to a specific ceiling runner. The first step in making the ceiling runner involved the forming of an inverted T-shaped runner with a vertical web and two horizontal flanges at the base of the web. One horizontal flange is disposed perpendicularly on each side of the vertical web. The ceiling runner structure is composed of a single piece of metal which is bent into the T-shaped configuration of the grid runner and therefore, the vertical web is formed with two pieces of material side by side fastened at the top of the vertical web but unfastened at the base of the vertical web.

A strip of material is provided to the underside of both horizontal flanges with the sides of the strip of material extending beyond the edges of the horizontal flanges. Each side of the strip of the material is wrapped around and placed slightly over each edge of the horizontal flange whereby the bottom and edges of the horizontal flanges are encased in the strip of material. The improvement herein is the application of some type of fastening technique to the base of the vertical web to bond together the two parts of the vertical web at the base of the vertical web and thus increase the rigidity of the inverted T-shaped runner.

DESCRIPTION OF THE PREFERRED EMBODIMENTS

The purpose of the invention herein is to provide a T-bar grid runner, fabricated with a double web and cap system, with added torque strength. One may desire to add strength in pounds per foot of deflection and in torque strength when twisting the T-bar. The addition of the strength is achieved by fastening together the two pieces of material forming the vertical web of the T-bar at the base of the vertical web with some type of mechanical type of fastening.

U.S. Pat. application, Ser. No. 399,822, filed July 19, 1982 and entitled "Reinforced Ceiling Runner and Method of Reinforcing a Ceiling Runner" is an example of an adhesively bonded together T-bar grid runner which will have increased torque resistance.

Figure 1:
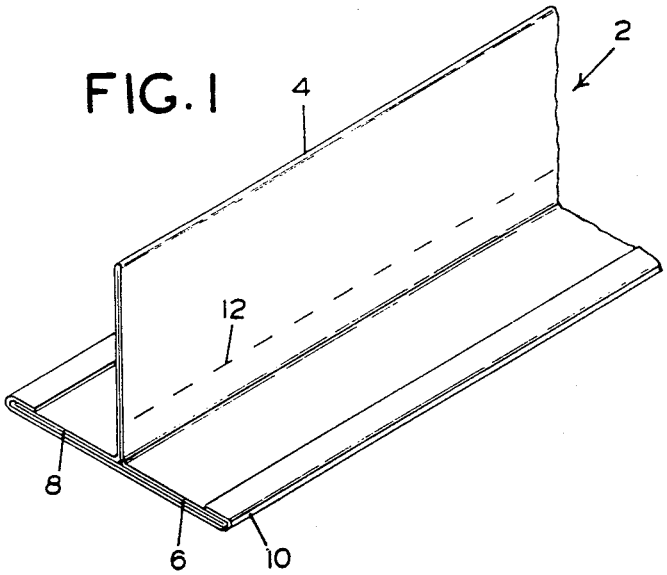
FIG. 1 is a perspective view of an inverted T-shaped runner with one type of rigidifying structure provided at the base of the vertical web.

Other techniques may be used to bond together the two pieces of material forming the vertical web of the T-runner at the base of the vertical web. In FIG. 1 there is shown a inverted T-shaped runner 2 with a vertical web 4 and two flanges 6 and 8. The two flanges 6 and 8 extend perpendicular from the vertical web 4 at the base of the vertical web. The cap structure 10 may be provided to the underside of the flanges 6 and 8 and wrapped around the outer edges of the flanges. The important thing to note is that the T-bar structure is formed from a single piece of material which is bent into the T-bar shape. The top of the vertical web has the fold in the sheet metal, forming the vertical web, which creates a two-piece structure for the vertical web. The sheet metal is folded back upon itself so that there is actually two side-by-side pieces of metal forming the vertical web. The pieces of metal are fastened together at the top of the vertical web by the fold in the sheet metal. However, normally at the base of the vertical web there is nothing fastening together the two pieces of sheet metal and it is primarily the cap structure which tends to hold the two pieces of sheet metal in an adjacent relationship in the base of the vertical web. A means 12 is provided at the base of the vertical web to fasten together the two pieces of material forming the vertical web. This may be the hot melt adhesive described in the above mentioned patent application. It could also be a seamless weld which is provided in that region or, alternatively, a spot welding which is provided along the dotted line indicated at 12. The spot welding would be a series of spot welds positioned approximately one and one-half inches on center.

Figure 2:
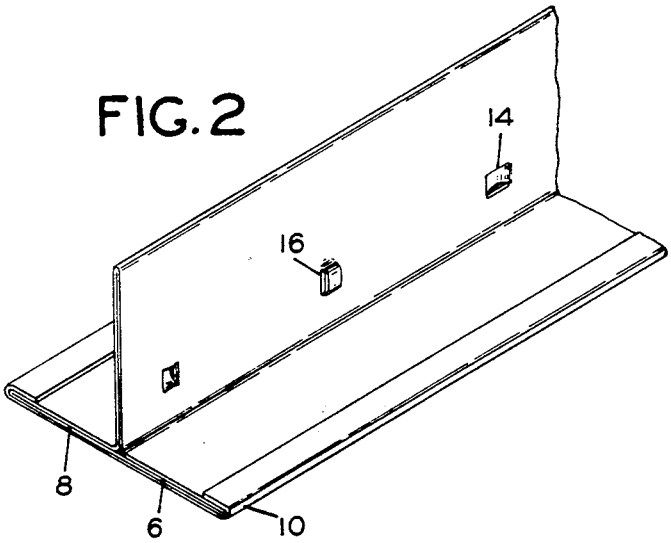
FIG. 2 is a perspective view of another inverted T runner with another fastening means provided at the base of the vertical web.

FIG. 2 shows an alternative techique wherein lances may be utilized to fasten the sheet metal pieces together forming the vertical web. Lances are typically used in the sheet metal art as a techique for fitting together two pieces of sheet metal so that they may be normally easily disconnected and reconnected. Lancing is simply carried out by stamping one side of the two pieces of sheet metal with a punch which pushes the sheet metal against a depressed die so that a portion of the sheet metal is not removed, but simply dislocated as shown in FIG. 2 to provide a mechanical bond for the two pieces of sheet metal. The lances may be provided in either a horizontal or vertical disposition as shown in FIG. 2 and normally the lances are provided 2" between the centers of the lances.

Some torque resistent tests have been applied to 24" lengths of T-bar. The T-bar runners are clamped in a vice at one end and at the opposite end of the 24 length of T-bar runner there is attached a torque wrench. The torque wrench is moved through a 90° arc and readings are taken of the torque as recorded by the torque wrench. These readings are then used to determine the degrees of rotation per inch pounds of torque. Using the same piece of stock for the T-bar which is a 0.015" thick pieces of sheet metal formed into a conventional T-bar with a vertical height of 1½" and a flange width of 5/16", the following results were calculated.

Control, no treatment at base of vertical web, 3.7°/in.-lbs.

Web spot welded at 2" on center, 1.0°/in.-lbs.

Hot melt adhesive in web, 1.8°/in.-lbs.

Horizontal lances, element 14, 2" on center, ¼" above horizontal flanges, 3.0°/in.-lbs.

Vertical lances, element 16, 2" on center, ¼" above horizontal flanges, 2.0°/in.-lbs.

It is quite clear from the above that the different techniques for fastening together the two pieces of sheet metal forming the vertical web in the base region of the vertical web do increase the torque resistance of the T-bar against torque loading. The higher torque strength makes the T-bar better able to resist the stresses which may occur in a suspended ceiling system utilizing the T-bar and makes the system easier to install.

What is claimed is:

1. An inverted T-bar runner structure for suspended ceilings comprising:

(a) an inverted T-shaped runner member having a vertical web with two horizontal flanges at the base of the web with one of each horizontal flange disposed perpendicularly on each side of the vertical web, (b) the vertical web being formed of two pieces of material side by side with the runner being formed from a single piece of material and the single piece of material being bent at the top of the vertical web so that the two pieces of material forming the vertical web are joined together at the top of the vertical web, but are normally unjoined at the base of the vertical web where the horizontal flanges extend outwardly from the vertical web, (c) a strip of material positioned against the underside of the horizontal flanges with the edges of the strip of material extending around and slightly over the outer edges of the horizontal flanges, and (d) the improvement comprising:

(1) providing a series of vertical lances in the region of the base of the vertical web to fasten together the two pieces of material forming the vertical web in the region about ½" above the base of the vertical web adjacent where the horizontal flanges are formed, said lances being spaced about 2" apart, and (2) said lances being formed by displacing a portion of the one piece of material forming the vertical web into the plane of the other piece of material forming the vertical web to mechanically bond the two pieces of material together.

* * * * *